United States Patent [19]

Le Masters

[11] 4,102,235

[45] Jul. 25, 1978

[54] DRUM PRACTICE PAD

[76] Inventor: Laurence G. Le Masters, 12 Monmouth Pl., Huntington Station, N.Y. 11746

[21] Appl. No.: 716,014

[22] Filed: Aug. 19, 1976

[51] Int. Cl.[2] ..... G10D 13/02

[52] U.S. Cl. ..... 84/411 R; 84/419

[58] Field of Search ..... 84/411 R, 414, 419, 84/411 P, 420

[56] References Cited

U.S. PATENT DOCUMENTS

| | | | |
|---|---|---|---|
| 2,078,004 | 4/1937 | Lebow | 84/411 P |
| 2,565,225 | 8/1951 | Gladstone | 84/411 P |
| 2,893,283 | 7/1959 | Ippolito | 84/411 P |
| 3,105,406 | 10/1963 | Ippolito | 84/411 P |
| 3,264,927 | 8/1966 | Fischetti | 84/411 P |
| 3,453,924 | 7/1969 | Glick et al. | 84/411 P |

*Primary Examiner*—Stephen J. Tomsky

*Attorney, Agent, or Firm*—Leonard H. King

[57] ABSTRACT

A practice pad for a drum or similar percussion instrument of the type fabricated of a construction material having sound-muffling characteristics and used in a directly supported position on the playing head of the drum, in the use of which all auxiliary structure to hold the pad on the drum vibrating playing head, and thus keep it in place, is eliminated. This is done simply by the advantageous selection of an appropriate weight oil-tanned leather as the construction material for the pad. In use, this specifically selected material has the proper weight to dampen, and thus muffle the drum auditory output and, also, by its sheer weight maintains a flat, surface-to-surface contact with the vibrating drum playing head, thus obviating any need for appropriate clamps or other structural members which typically are attached to the drum and to the pad.

2 Claims, 16 Drawing Figures

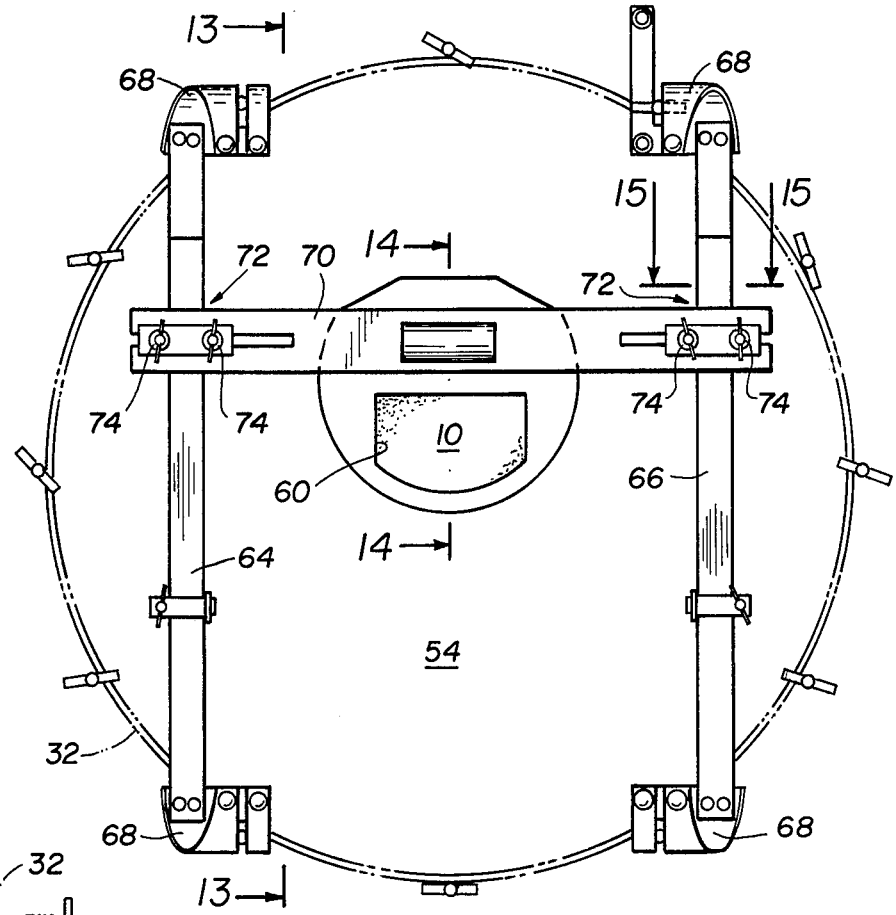
FIG.12
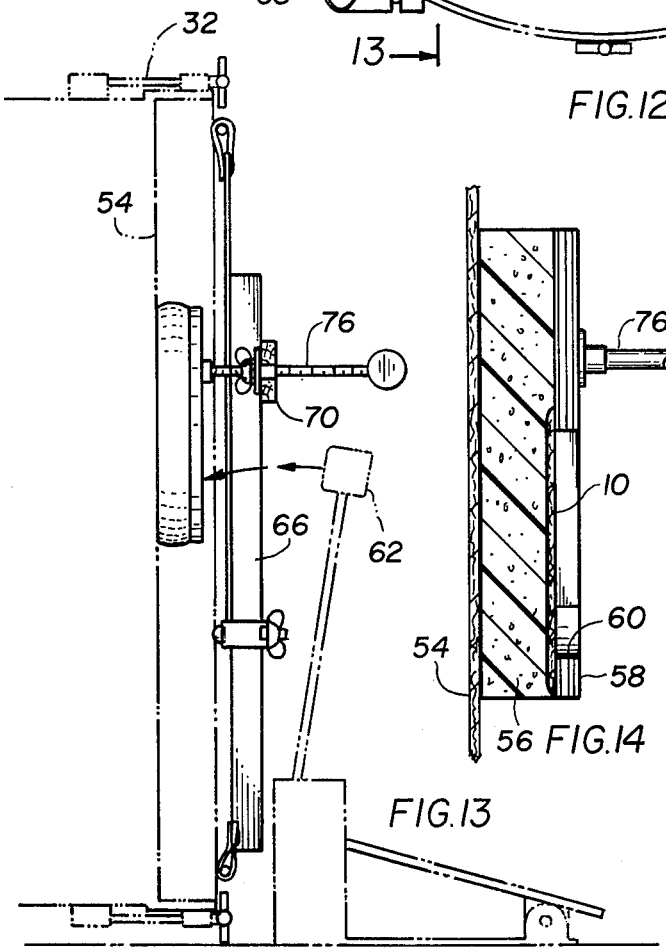
FIG.13
FIG.14
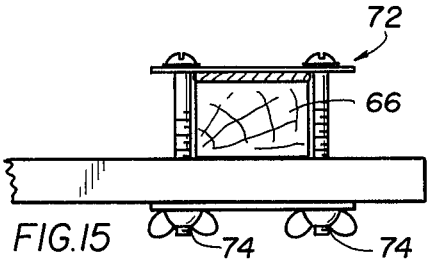
FIG.15
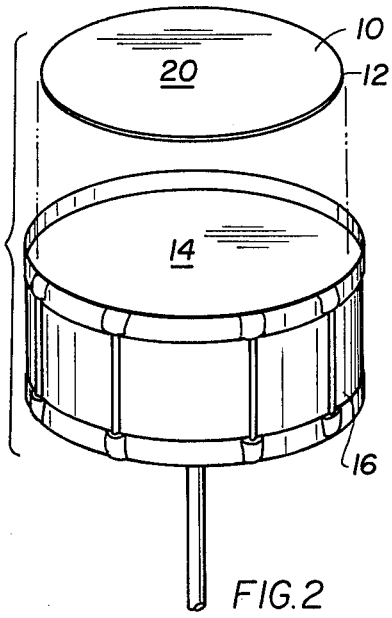
FIG.2

DRUM PRACTICE PAD

The present invention relates generally to a drum practice pad, and more particularly to a weighted pad which, once placed on a drum playing head, reduces the sound output to a suitable "practice" level without adversely affecting the tonal quality of the muffled sound and, more important, does not unduly shift around so as to require position-holding fixtures or the like.

Sound-muffling pads, typically fabricated of felt or soft rubber, that are placed as covers directly on the drum playing head, as exemplified by the pads of U.S. Pat. Nos. 2,078,004 and 3,453,924, have to be held in place, by braces or similar structure, and also are usually so flimsy that a rigid base is required. The positioning braces and rigid base not only adversely interfere with use of the pads, but also contribute to unrealistic tonal qualities in the muffled sound, and thus detract from the utility of this class or type of drum practice pad.

Broadly, it is an object of the present invention to provide an improved drum practice pad overcoming the foregoing and other shortcomings of the prior art. Specifically, it is an object to provide a drum playing head cover or pad which effectively muffles the sound to an acceptable "practice" level, without altering the tonal quality thereof, and which obviates any need for pad-positioning structure.

A drum practice pad demonstrating objects and advantages of the present invention is constructed from oil-tanned leather in a flat disc-like shape sized to cover the supporting drum playing head and is of a weight in the range of five to seven ounces per square foot, to thereby contribute by its weight both to a reduction in the vibratory motion of the drum playing head and to minimize any shifting movements from its operative position in covering relation over the drum playing head.

The above brief description. as well as further objects, features and advantages of the present invention, will be more fully appreciated by reference to the following detailed description of a presently preferred, but nonetheless illustrative embodiment in accordance with the present invention, when taken in conjunction with the accompanying drawings, wherein:

FIG. 2 is a perspective view which illustrates the positional relation of the pad to the playing head of a drum;

Figure 4:
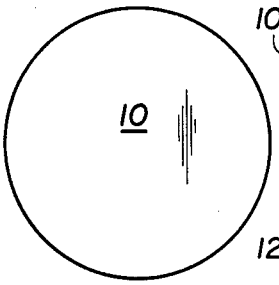
Figure 5:
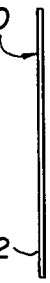
Figure 6:
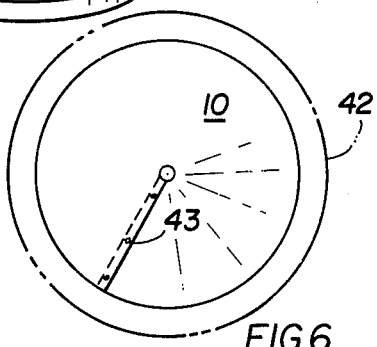
Figure 7:
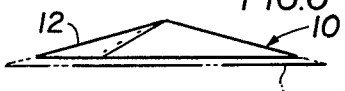
Figure 8:
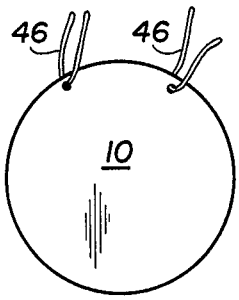
Figure 9:
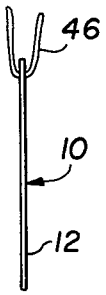
Figure 10:
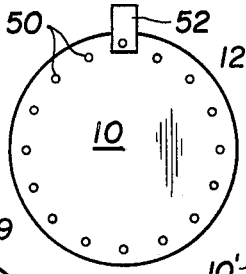
Figure 11:
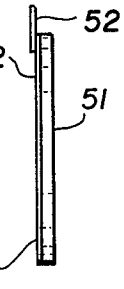
Figure 16:
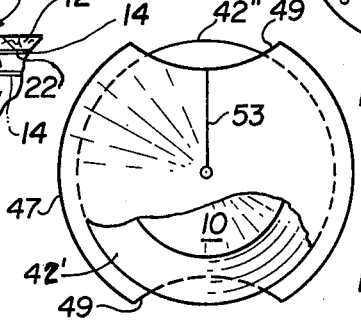

FIGS. 4 and 5 respectively are plan and side elevational views of a practice pad according to the present invention in its simplest form, namely as a flat disc-like shape;

FIGS. 6 and 7 respectively are a plan and side elevational view of a practice pad of an appropriate shape for placement on a cymbal;

FIGS. 8 and 9 respectively are plan and side elevational views of the pad equipped with tie strings to assist in the mounting attachment of the pad to a drum which may have a slightly inclined or angled playing head;

FIGS. 10 and 11 respectively are plan and side elevational views illustrating a practice pad constructed specifically for use with a snare drum;

FIG. 12 is a front elevational view of a bass drum having associated therewith preferred structure for mounting the within pad in sound-muffling relation to the vertically oriented playing head of this drum;

FIG. 13 is a side elevational view, in section taken along line 13—13 of FIG. 12, showing further structural details;

FIG. 14 similarly is a sectional view, taken along line 14—14 of FIG. 12, showing further structural details of the pad;

FIG. 15 is a sectional view taken along lines 15—15 of FIG. 12 showing further structural details of the mounting structure; and FIG. 16 is a partially broken away plan view of a "hi-hat" cymbal assembly.

Figure 1:
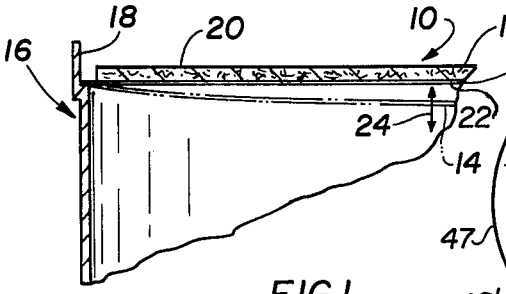
FIG. 1 is a partial side elevational view in section, and on an enlarged scale, which diagrammatically illustrates the manner in which the improved drum practice pad hereof achieves its sound-muffling function.

Reference is now made to the drawings and, in particular, to FIGS. 1 and 2 which show all of the essential features of the improved drum practice pad, generally designated 10, according to the present invention. While these two figures are all that are necessary for a complete understanding of the invention, for completeness sake the remaining drawings, FIGS. 3–16 are provided to illustrate how the improved drum practice pad 10 hereof is adapted to be positioned on each of the drifferent types of drums that are part of a typical drum set. The description which accompanies FIGS. 3–16, however, will be somewhat abbreviated since the more detailed description of the pad 10 provided in connection with FIGS. 1 and 2 is sufficient to demonstrate the patentable novelty of the pad 10 over prior art or known drum practice pads.

In the above connection, it is already well known, as exemplified for example in U.S. Pat. Nos. 2,078,004 and 3,453,924, that there is a need for a pad to be placed directly as a cover over the playing head of a drum and constructed of sound-muffling material so as to absorb some of the vibration that otherwise would be imparted to the drum playing head and thus correspondingly would add to the sound output of the drum. Thus, to the extent that some vibration is absorbed, the sound output is correspondingly reduced and in this way it is maintained at a "practice" level. As the name implies, a typical practice pad as used in the manner just described enables the drummer to practice on his drum with minimum disturbance to those within earshot of the drums. The prior art practice pads are limited to a construction material consisting of felt, elastomeric or plastic materials which are used with or without a rigid base. While these materials have the desired sound-muffling characteristics, they do not also possess any significant inherent characteristic for maintaining their positional relation to the drum playing head and thus invariably these prior art drum practice pads must have appropriate mounting structure for maintaining their position in relation to the playing head. In other words, during use of the practice pads, when it is being repeatedly struck by the drum sticks, and thus when the underlying supporting drum playing head is set in vibration, even though this vibration is of a reduced extent due to some of the contact being absorbed by the pad, there is nevertheless enough vibratory motion being imparted to the practice pad so that some form of mounting structure is required in order to maintain the positional relationship of the practice pad on the vibrating drum playing head. This function, as already noted, is achieved in the prior art by using appropriate clamps or other structural members which are attached to the drum and also to the pad.

One of the important contributions of the present invention is the elimination, for all practical purposes, of any position-providing or position-maintaining structure for the practice pad hereof which in any significant way interferes with the use of the pad. Instead, and in accordance with the present invention, the proper positional relation of the pad to the drum playing head is provided by the selection of a construction material for the pad which has sufficient weight, both to result in a significant reduction in the vibratory motion of the drum playing head, a requirement that is of course necessary in order to achieve the sound-muffling function of the pad, and which also, again by its sheer weight, is effective to minimize any shifting movements of the pad relative to the drum playing head. Thus an important aspect of the present invention is the selection of an oil-tanned leather for fabrication of the pad 10, this material having the appropriate inherent ability to muffle sound and, because of its treatment with oil during the tanning thereof, having the additional inherent characteristic of being of sufficient density and weight to maintain its physical contact with the vibrating drum playing head. Stated another way, because the practice pad 10 hereof is not flimsy or lacking in sufficient density or body, as is the case with prior art felt pads or thin rubber pads, it maintains a position flush against the drum playing head during practice sessions when it provides sound-muffling service. In this connection, it is no solution to supply rigidity to the felt or elastomeric pad by mounting it on a rigid base since the rigid base very seriously affects the vibratory motion of the drum playing head and thus not only muffles the sound of the drum, but also totally changes the tonal qualities that are produced while using the practice pads so that it is so unrealistic as to seriously detract from its usefulness as a practice aid.

Referring now specifically to FIGS. 1, 2, pad 10 will be understood to be fabricated, in the simple flat disc-like shape illustrated, from appropriate oil-tanned leather, designated 12, of a weight in the range of five to seven ounces per square foot. This weight leather, while providing the desired reduction in sound without seriously detracting from the tonal qualities, has been found in practice to effectively maintain its position flush against the vibrating playing head 14 of drum 16 without any structural members actually physically attaching the pad 10 to the drum 16. Pad 10 is merely placed on the playing head 14 within the confines of the rim 18, and when the playing head 14 is subsequently set in motion, which occurs when the pad surface 20 is struck by the drum sticks, an advantageous smooth surface contact is maintained, as at the interface 22, and it is believed that this is due to the weight of approximately five to seven ounces per square foot of the pad 10 which bears down against the playing head 14.

It should also be noted, as is perhaps best illustrated in FIG. 1, that during the reciprocating vibratory motion 24 of the drum playing head 14, that the pad 10 by virtue of its supported position on the playing head 14 serves to dampen, and thus reduce the extent of, this vibratory motion and in this way correspondingly reduces the audible output of the drum 16. Apparently, however, the character of the vibratory motion 24 is not significantly changed and thus the tonal qualities of the auditory output of the drum while using the pad 10 is sufficiently realistic to contribute to its value as a practice aid.

An appropriate oil-tanned leather suitable for fabrication of the pad 10 can be obtained from numerous commercial sources, one such source being R & G Leather, Spring Street, New York, New York.

Figure 3:
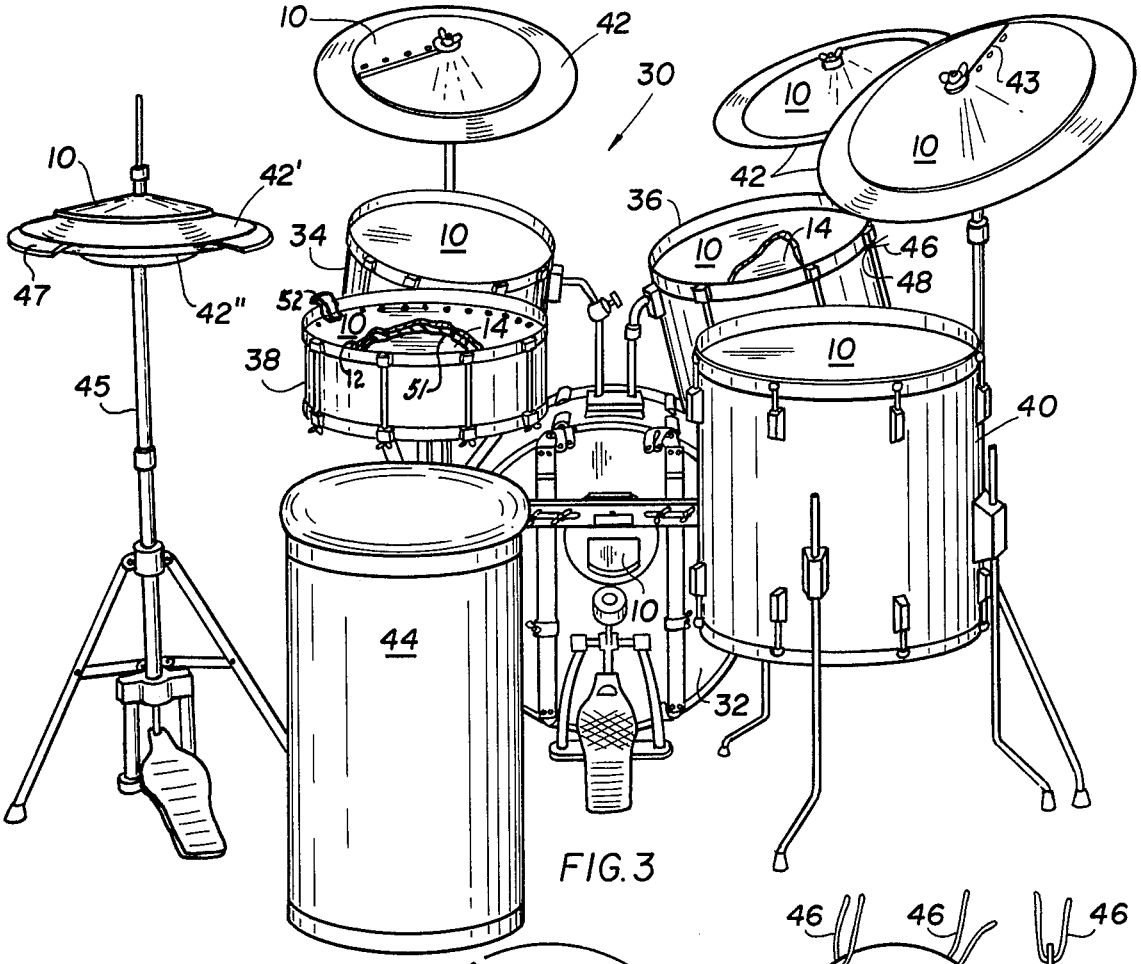
FIG. 3 is a front perspective view of a typical six-piece drum set, each piece of which, according to the present invention, is equipped with the within inventive practice pad.

For completeness sake, reference is now made to FIGS. 3–16 which illustrate use of the practice pad 10 hereof in connection with a typical six-piece drum set. More particularly, as illustrated in FIG. 3, the six-piece set, generally designated 30, includes a bass drum 32 on which are mounted tenor tom toms 34 and 36, as well as a snare drum 38. Completing the six-piece set is a floor tom-tom 40 and various cymbals, individually and collectively designated 42. The drummer positions himself on an appropriate stool 44 within reach of all of the percussion instruments just identified. In this connection, a practice pad 10 constructed in accordance with the present invention will be understood to be appropriately positioned on all of the playing heads of the various drums and thus enables the musician to practice on a complete drum set with an appropriately reduced volume and thus practice the necessary stick-control and other drumming techniques that are required for a complete drum set. In FIG. 3, the practice pads 10 hereof are partially shown in section to illustrate their respective positioning on the playing heads 14 of the drums 36, 38.

Because of the horizontal orientation of the drum 40, the positioning of the pad 10 on the playing head 14 is readily achieved by the sheer weight of the pad and there is nothing further required to provide the necessary positional relationship of the pad on the playing head 14. Accordingly, use is made of the simple form of pad 10 shown in FIGS. 4 and 5.

On the other hand, due to the slight angular orientation of the tom tom 36, a slightly modified pad 10 as illustrated in FIGS. 8 and 9 is recommended. Pad 10 of FIGS. 8, 9 includes tie strings 46 which in practice are advantageously tied, as at 48 (see FIG. 3), to the drum hardware.

As shown in FIG. 3, another contemplated construction for the practice pad 10' hereof illustrated in FIGS. 10 and 11 is one intended specifically for use over a snare drum which has a characteristic "piercing" sound. This construction contemplates spaced clinch nails, individually and collectively designated 50, provided about the periphery of the leather pad 10 which attaches a soft rubber pad 51 to it, of the same size and shape, which provides the additional muffling necessary to tone down the snare drum. A tab 52 attached to pad 10 facilitates removal of the pad 10.

To conform to the conical shape of the cymbal 42, pad 10 has a radial separation equipped with snaps 43 and, in effect, is wrapped about the cymbal 42, all as clearly illustrated in FIGS. 6, 7.

Reference is now made to FIGS. 12–15 which show an appropriate manner of utilizing the practice pad 10 hereof in association with a vertically oriented playing head, specifically designated 54 in FIG. 12, of the bass drum 32. Since as already noted it is important that all of the different types of drums that are usually part of a drum set be equipped with a sound-muffling pad so that all of them can be utilized during a practice session, it is of course necessary that the practice pad 10 hereof be mounted in an appropriate positional relation to the vertically oriented playing head 54. Pad 10 for the bass drum 32 is modified because of its use with this specific drum, the modifications being best illustrated in FIG. 14. More particularly, while the pad 10 is still fabricated of leather, because of the vertical orientation of the playing head 54 it is not possible to rely on the weight of the pad to maintain its proper position relative to the vibrating surface 54. Thus, pad 10 is mounted on a rigid base member 56 which is held in physical contact against the playing drum head 54 by a circular clamping ring 58, ring 58 having an access opening 60 through which the beater 62 is able to strike pad 10.

To adjust the position of the pad 10 relative to the playing head 54 use is made of two vertically oriented supports 64 and 66 attached at their upper ends by clamps, individually and collectively designated 68, to the rim of the bass drum 32. A horizontally oriented support 70 is mounted in spanning relation across the playing head 54 and at its opposite ends has slides 72 which include threaded bolts 74 which, when tightened, maintain the horizontal position of the support 70. This, of course, also maintains the position of the pad 10 which is held by the clamp rod 76 (see FIG. 14) against the base 56.

Referring to FIGS. 1 and 16, the "hi-hat" cymbal assembly 45 is a foot pedal operated cymbal. Upon depressing the pedal, the upper "hi-hat" cymbal 42' is raised above the stationary lower cymbal 42'' and then dropped thereon to create a "chink" sound. The leather pad 47 is provided with arcuate cut-outs 49 to prevent air-tight sealing occurring between the upper and lower cymbals and the leather. Slit 53 permits sliding the leather between the upper and lower cymbals, without disassembly of the apparatus.

From the foregoing, it should be readily appreciated that there has been described herein, particularly in connection with FIGS. 1 and 2, a significantly improved practice pad for a drum which effectively muffles the sound of the drum without destroying the tonal qualities and which, by its sheer weight, due to the fact that it is fabricated of an oil-tanned leather, effectively maintains its position on the vibrating playing head of the drum without any mounting or other positioning structure. A latitude of modification, change and substitution is intended in the foregoing disclosure, and in some instances some features of the invention will be employed without a corresponding use of other features. Accordingly, it is appropriate that the appended claims be construed broadly and in a manner consistent with the spirit and scope of the invention herein.

What is claimed is:

1. In combination a drum and a drum practice pad of the type fabricated of a construction material having sound-muffling characteristics and used in a directly supported position on the playing head of said drum, said pad comprising a flexible, oil-tanned leather in a flat disc-like shape sized to cover said supporting drum playing head, to thereby contribute by its weight both to a reduction in the vibratory motion of the drum playing head and to minimize any shifting movements of said pad relative to said drum playing head.

2. The improved oil-tanned drum practice pad as claimed in claim 1 wherein the leather has a weight in the range of five to seven ounces per square foot.

* * * * *